United States Patent [19]

Walton

[11] Patent Number: 5,063,328

[45] Date of Patent: Nov. 5, 1991

[54] ENERGY SAVING CIRCUIT FOR DISCHARGE TUBES

[76] Inventor: John F. Walton, 6853 Strata St., McLean, Va. 22101

[21] Appl. No.: 199,279

[22] Filed: May 26, 1988

Related U.S. Application Data

[63] Continuation of Ser. No. 942,710, Dec. 17, 1986, abandoned.

[51] Int. Cl.[5] ..... H05B 39/00

[52] U.S. Cl. ..... 315/96; 315/97; 315/95; 315/94; 315/102; 315/DIG. 5

[58] Field of Search ..... 315/94, 96, 97, 95, 315/98, 100, 99, 105, 106, 107, 244, 227 R, 228, 102, 101, 103, 104, 277, 276, 278, DIG. 5, DIG. 2

[56] References Cited

U.S. PATENT DOCUMENTS

| | | | |
|---|---|---|---|
| 2,897,403 | 7/1959 | Charbonneaux | 315/103 |
| 3,170,085 | 2/1965 | Genuit | 315/244 |
| 3,549,942 | 12/1970 | Nijholt | 315/102 |
| 3,851,209 | 11/1974 | Murakami et al. | 315/103 |
| 3,866,087 | 2/1975 | Powell | 315/104 |
| 4,016,452 | 4/1977 | Willis | 315/278 |
| 4,399,391 | 8/1983 | Hammer et al. | 315/244 |
| 4,425,530 | 1/1984 | Hammer et al. | 315/104 |
| 4,461,976 | 7/1984 | Yamamoto et al. | 315/104 |
| 4,547,705 | 10/1985 | Hirayama et al. | 315/278 |
| 4,568,857 | 2/1986 | Head | 315/244 |

*Primary Examiner*—Michael Razavi
*Attorney, Agent, or Firm*—Howard L. Rose

[57] ABSTRACT

Circuits for increasing the efficiency of fluorescent tubes by openings one side of all of the filament circuits of the tubes in response to flow of plasma current. The circuits may be employed in conjunction with the circuits of Lucetta U.S. Pat. No. 3,954,316. It should be noted that solid state relays could also be employed so that filament current, although not completely terminated, would be substantially terminated and filament losses would be inconsequential.

17 Claims, 8 Drawing Sheets

56
58
K1
66
CPCR
42
K2
96
102
TK
98
2
12
36
14
K2
100
88
K1
6
20
K2
76
70
8
99
22
K2
16
K2
78
26
9

CPCR
30
42
2
10
K2a
H4
36
102
100
L2
K2b
6
K2c
76
70
8
K1
TK
106
TK
K2
K2d
26
78
L1
99
98
9

ENERGY SAVING CIRCUIT FOR DISCHARGE TUBES

This is a continuation of application Ser. No. 942,710, filed Dec. 17, 1986, and now abandoned.

The present invention relates to a discharge type lamp circuit and more particularly to a fluorescent lamp circuit for reducing the power consumption of such a lamp circuit while reducing the light.

BACKGROUND OF THE INVENTION

Lucetta U.S. Pat. No. 3,954,316 discloses a circuit which reduces the power consumption of a conventional fluorescent lamp circuit by about 45% but reduces the light output by about the same percentage. Such a device is acceptable in overlighted areas but is not useful in properly illuminated areas.

It is obviously desirable to be able to decrease the power consumption of such circuits without reducing the light output and alternatively to proivde such a circuit that can also be used in conjunction with the Lucetta circuit to achieve still further reductions in power consumption.

BRIEF DESCRIPTION OF THE INVENTION

The present invention relates to ionized gas plasma tubes which are hereinafter referred to as discharge type tubes. In accordance with the present invention, there is provided a circuit for deenergizing the heater circuits of one or more fluorescent tubes after the tube has established plasma current flow; which circuit may be used alone or in conjunction with the aforesaid Lucetta circuit. Specifically, the circuit of the present invention includes means responsive to the flow of plasma current through one or more fluorescent tubes to activate one or more relays to open the heater circuits in the fluorescent tube(s) thereby reducing current flow without reducing light emission. The circuit may employ electromechanical or thermal relays. The circuit may be utilized alone or in combination with the Lucetta circuit and this may be employed in both overlighted and any lighted areas as original equipment or as a retrofit.

It is thus the primary object of the invention to provide a circuit for reducing the power consumption of fluorescent lamp circuits without reducing the illumination provided by the lamps; the circuit employing one or more relays to disable the heater circuits of the lamps upon establishment of plasma current flow and being compatible with the Lucetta circuit.

DETAILED DESCRIPTION OF THE INVENTION

Figure 1:
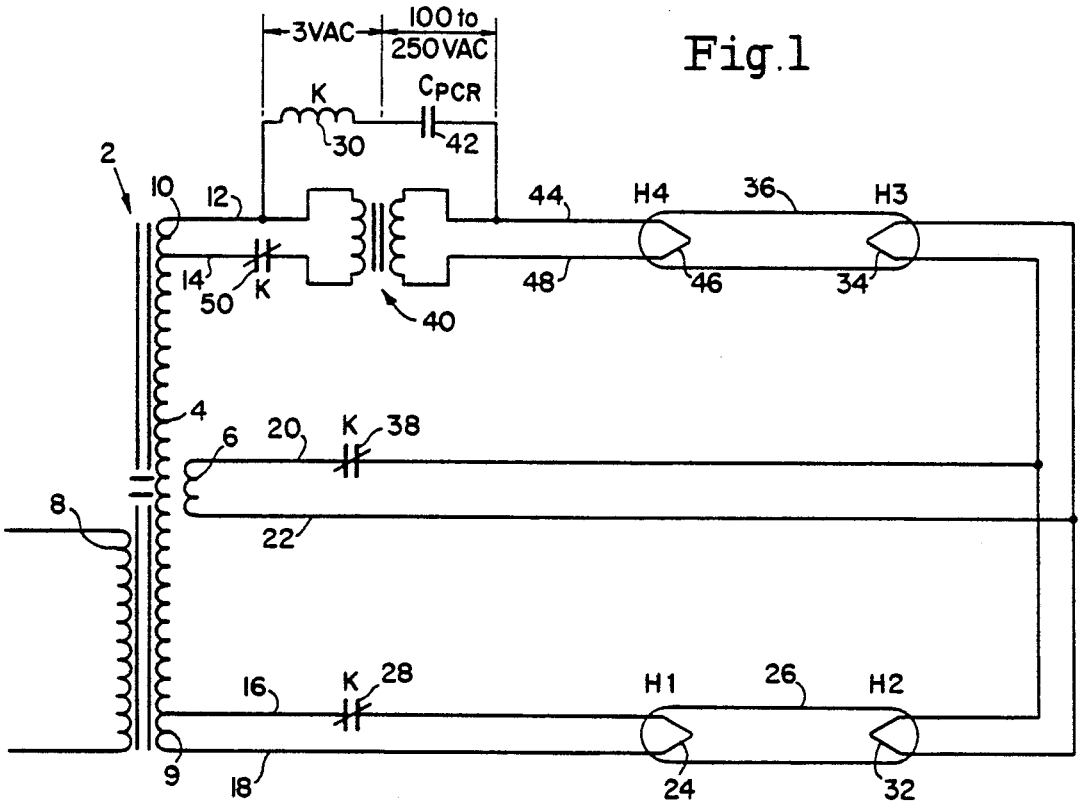
FIG. 1 illustrates a circuit diagram of one embodiment of the present invention in combination with the Lucetta circuit.

Referring now specifically to FIG. 1 of the accompanying drawings, the circuit illustrated includes a ballast 2 providing a secondary winding 4, a ternary winding 6 and a primary winding 8. A first top 10 is taken from one end of the secondary winding to provide a filament voltage across leads 12 and 14. A second top 9 is provided at the other end of winding 4 to provide a filament voltage across leads 16 and 18. The ternary winding provides a filament voltage across leads 20 and 22.

The leads 16 and 18 are connected across a filament 24 of fluorescent tube 26 with normally closed contacts 28 of a relay including coil 30, located in lead 16. Filaments 32 and 34 of tubes 26 and 36 respectively, are connected in parallel across leads 20 and 22 with normally closed contact 38 actuatable coil 30 connected in lead 20. The leads 12 and 14 are connected across a transformer 40 which in conjunction with a capacitor 42 forms the Lucetta circuit. The capacitor 42 is connected in series with relay coil 30 from lead 12 to one side of filament 44 f tube 36 via lead 44. The filament 46 is connected via leads 44 and 48 across the secondary winding of the transformer 40. To complete the circuit normally closed contact 50 of the relay is connected in lead 14.

In operation, the coil 30, being connected in series with the circuit of tube 36 receives virtually no current during initial heating of the filaments 34 and 46. Upon conduction of plasma current through the tube 36, the coil 30 is energized, and the contacts 28, 38 and 50 are opened, deenergizing all filaments. The capacitor 42 performs its normal function as in the Lucetta circuit providing about a zero to 65% reduction in power consumption while the deenergization of the filaments produces another, approximately, 5% reduction but without further reducing light output.

Typical operating parameters of such a circuit are 180 to 300 volts across the extremities of the secondary winding 4 and a plasma current of about 300 or more milliamperes, more than sufficient to actuate the relay coil 30. With the capacitor 42 in the circuit, a voltage drop of about 250 VAC occurs across the capacitor 42; about 3 VAC across coil 30, and the plasma current is reduced to about 150 ma with a 50% reduction in illumination. Each filament consumes about 1.5 watts for good starting characteristics. Thus by rising the circuit of the present invention in a typical two tube system, a reduction of 6 watts more than heretofore is achieved. A total reduction of about 53 watts is achieved; some loss occurring in the coil 30.

Figure 2:
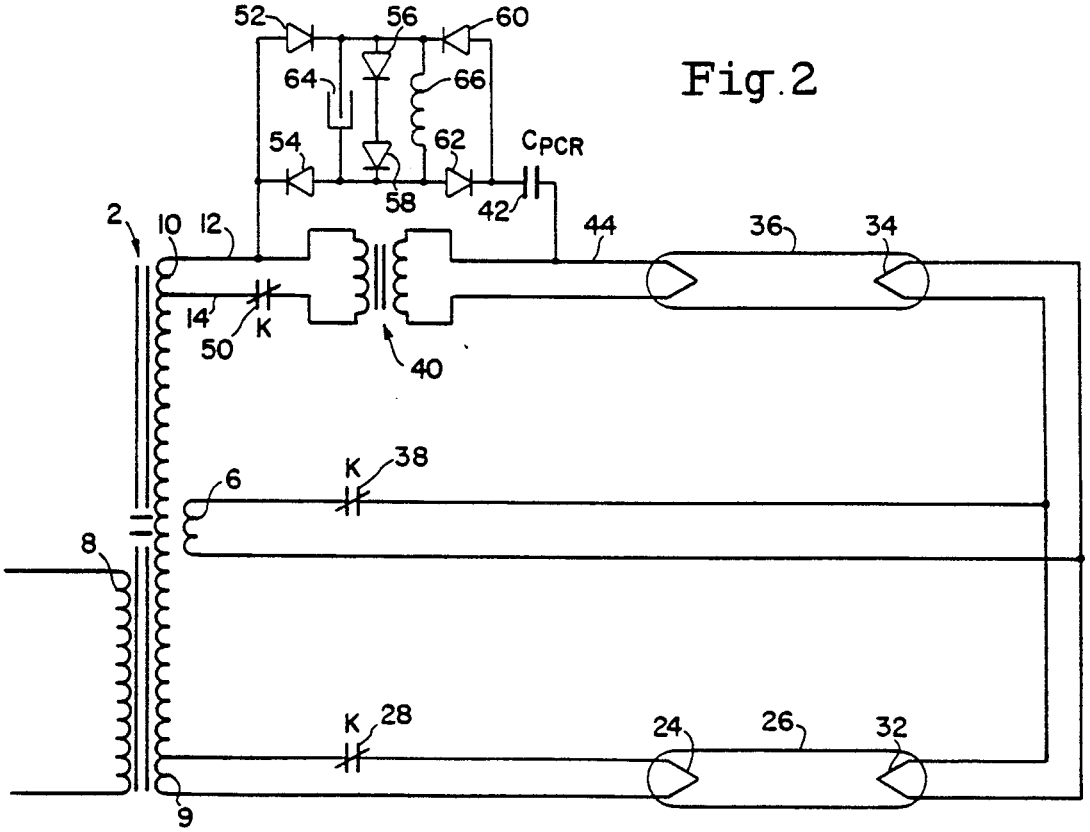
FIG. 2 illustrates a circuit diagram the same as FIG. 1 but employing a DC rather than AC relay.

The coil 30 of FIG. 1 may cause the relay to produce a buzzing sound. Various approaches to the solution of this problem is illustrated in FIG. 2 of the accompanying drawings. All elements of the circuit are the same as in FIG. 1 except for the relay 30. The AC relay 30 is replaced by a small relay equipped with a bridge rectifier and filter capacitor. The capacitor materially reduces if not eliminates the buzz action often found in small relays operating on rectified alternating current.

The reference numerals of FIG. 2 are the same as in FIG. 1 for common elements. A bridge rectifier having diodes 52, 54, 60 and 62 is inserted in the circuit between leads 12 and 44 with oppositely poled diodes 54 and 62 in series with capacitor 42, as are opposite diodes 52 and 60. A smoothing capacitor 64 is in parallel with coil 66 of the relay.

To protect the coil 66 from damage in the event of shorting of the capacitor 42, voltage surges on other malfunction diodes 56 and 58 are connected in series across the bridge and in parallel with the relay coil. Any large increase of voltage across the coil, produces conduction or sufficient increase in conduction of the diodes, thus protecting the coil. The bridge rectifier and capacitor 64 produce a relatively smooth DC across the coil and substantially eliminates jitter and buzzing of the relay.

Figure 3:
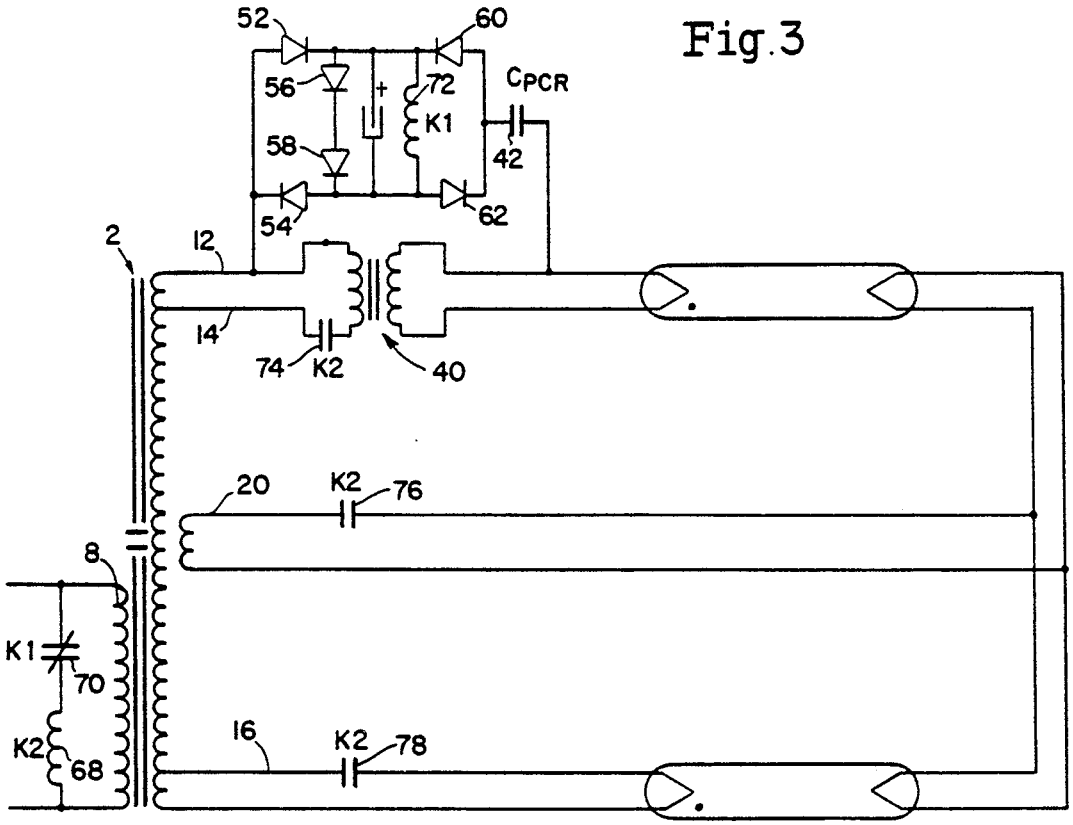
FIG. 3 illustrates a modification of the circuit of FIG. 2.

The relay of FIG. 2 may consume more current than is desirable but this problem is readily overcome by the circuit of FIG. 3. In this embodiment, a relay coil 68 is connected in series with normally closed contacts 70 of another relay having a coil 72. The relay of coil 68 has normally open contacts 74, 76 and 78 connected in leads 14, 20 and 16. The coil 72 is located in the circuit in the same place as the coil 66 of FIG. 2.

In operation, upon application of voltage across the primary winding of 8 of transformer 2, the relay coil is energized and closes contacts 74, 76 and 78. The filaments are heated and upon plasma conduction the relay coil 72 is energized, opens its contacts 70 and deenergizes coil 68. Contacts 74, 76 and 78 open and the filaments are deenergized.

The advantage of this circuit is that a relay that activates only one contact draws less power than a relay that activates three contacts. Since contacts 74, 76 and 78 are normally open the only relay coil that remains energized after plasma conduction is coil 72 which actuates only one contact, contact 70.

The circuits thus far described utilize the transformer 40 to provide the heater current to filament 46 and provide conductive isolation between the ballast and the filament . Thus capacitor 42 may be inserted to complete the plasma current circuit. It may be desirable to eliminate the transformer 40 for cost reasons, in which case the circuit of FIG. 4 becomes desirable. Lead 12 is connected via a relay coil 78 and the capacitor 42 to lead 80 to filament 82 of tube 84. The other side of filament 82 is connected via a lead 86 to lead 14 through series connected normally closed contacts 88 and 90. A normally closed contact 92 is connected in series with the second filament 93 of tube 84. Completing the heater circuit normally closed contacts 94 and 96 in series are connected in parallel with coil 78 and capacitor 42 in series and a thermal relay 98 is connected across leads 80 and 86. Contacts 88 and 96 are associated with thermal relay 98 and contacts 90, 92 and 94 are associated with relay coil 78.

In operation, upon starting heater current to one side of filament 82 is supplied from lead 12 through contacts 94 and 96 to lead 80 and after passing through the filament 84 via lead 86 and contacts 88 and 90 to lead 14. The coil 78 and capacitor 42 are bypassed at this point. The thermal relay begins to heat and is heated to a temperature necessary to open its contacts 88 and 96 only after the time interval necessary to heat filaments 82 and 93 to the extent necessary to fire the tube and establish plasma current. When contacts 88 and 96 are opened, the coil 78 and capacitor 42 are inserted into the circuit, the plasma current path being now completed through the coil 78 in series with capacitor 42. The relay opens its contacts 90 and 94 so that when the thermal relay cools and its contacts 88 and 96 are closed, the filament 82 is not reenergized. The contact 92 is also opened and the filament 93 no longer receives current.

Thus it is seen that the use of the two sets of contacts in series with the filament 82 permits the insertion of the capacitor in series with the plasma current without the necessity of using the transformer 40 of FIG. 1.

Figure 4:
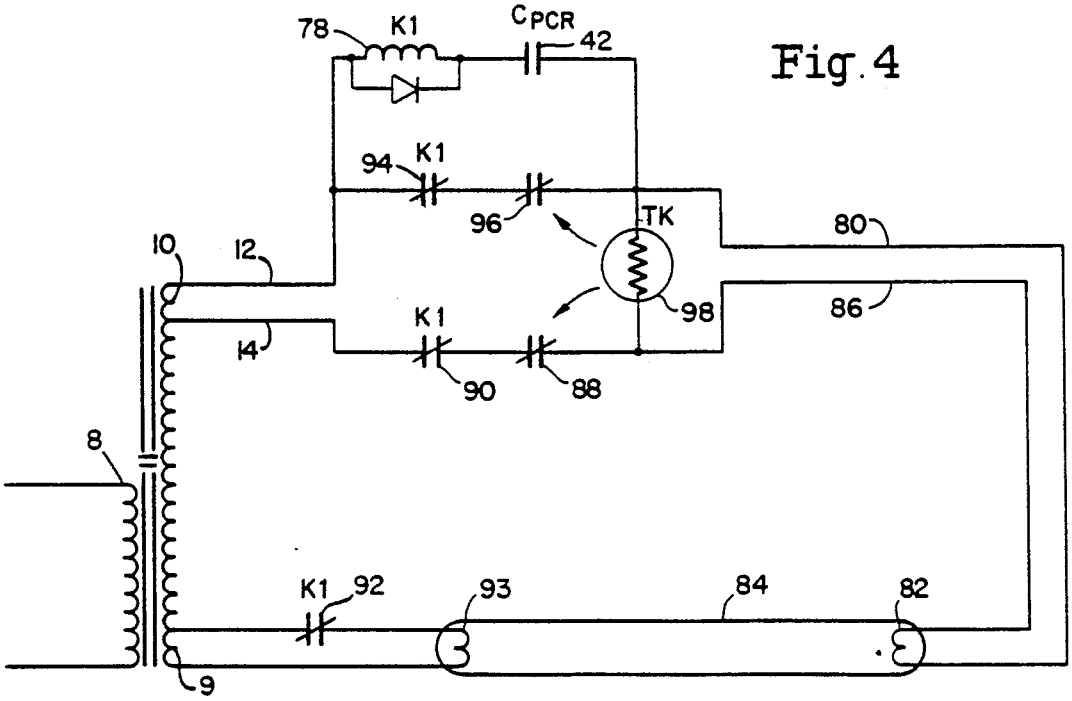
FIG. 4 is a modification of FIG. 1 eliminating the Lucetta circuit and employing a thermal relay.
Figure 5:
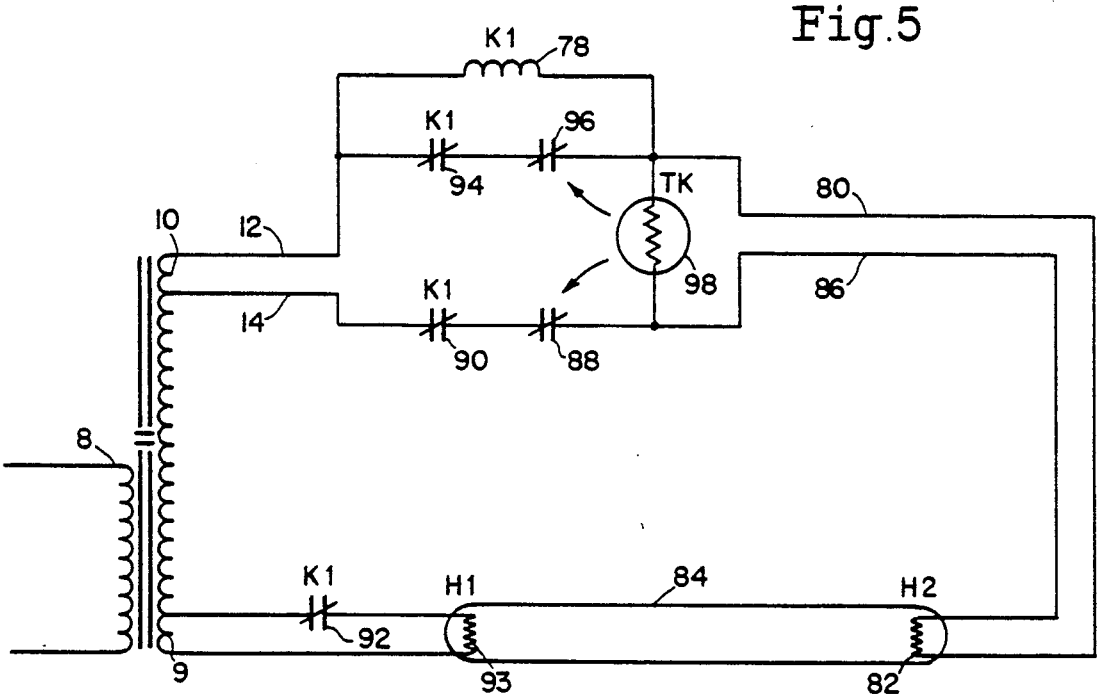
FIG. 5 illustrates a modification of FIG. 4 employing a voltage dropping capacitor to reduce power consumption.

As previously indicated, the filament current control circuit of the present invention may be utilized without capacitor 42 and reference is now made to FIG. 5 of the accompanying drawings. This circuit is identical to the circuit of FIG. 4 except that the capacitor 42 has been omitted. Thus the light and energy reduction effect is not achieved but a 5% reduction in energy consumption in the filament circuits is achieved.

Figure 6:
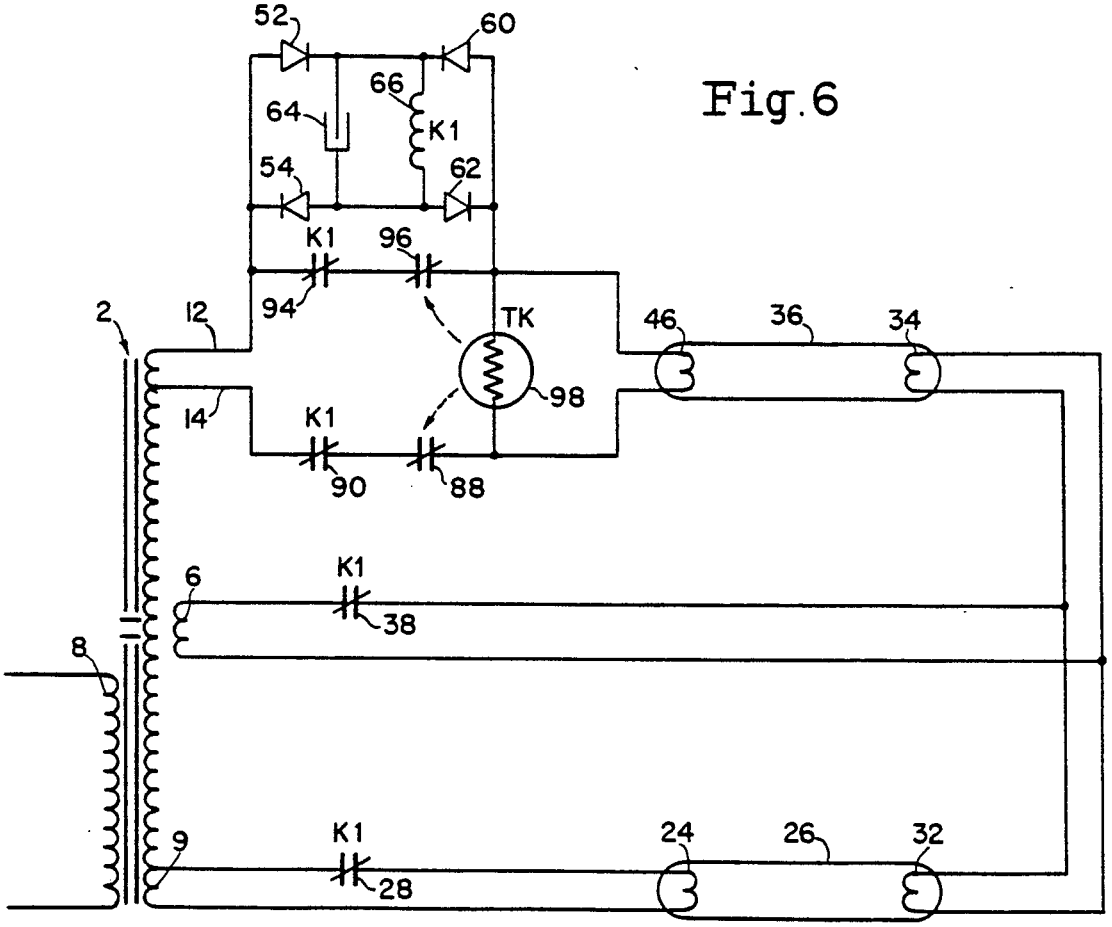
FIG. 6 illustrates a modification of the circuit of FIG. 5 employing a DC relay.

Referring to FIG. 6, the relay circuit of FIG. 2 may also be employed without the Lucetta circuit; utilizing the substitute circuit for the transformer 40 as disclosed in FIG. 4. Thus the bridge rectifier and capacitor 64 of FIG. 2 is used in conjunction with the transformer substitute circuit of FIG. 4 employing thermal relay 98. A two tube circuit is illustrated which requires the relay coil 66 to operate four sets of contacts.

Although the circuit of FIG. 6 operates very well as indicated it requires a four pole relay, since coil 66 must operate contacts 90, 94, 28 and 38. The power drain may, in some instances, be more than is desirable.

Figure 7:
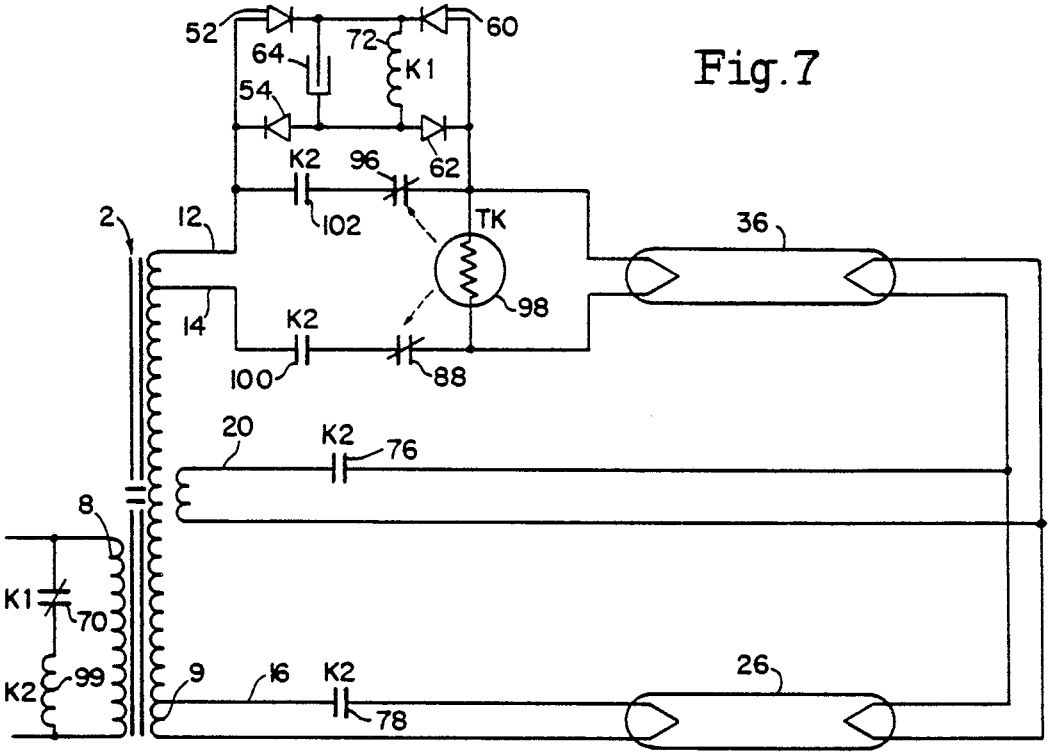
FIG. 7 is a circuit employing features of FIGS. 3 and 6.

Referring to FIG. 7 of the accompanying drawings, the problem with the circuit of FIG. 6 is overcome by employing the two relay circuit of FIG. 3 in combination with the thermal relay circuit of FIG. 4 and bridge rectifier circuit of FIG. 2. In this circuit however, a relay coil 98 across the primary 8 of the ballast 2 operates normally open, relay contacts 100 and 102 in series with each of the thermal relay contacts 88 and 96, respectively.

In the operation of this circuit, the relay coil 99 when energized closes its contacts 100 and 102 to commence heating the thermal relay element 98. The relay 98 after the appropriate time delay opens to contacts 88 and 96 thereby causing energization cf relay coil 72. Coil 78 opens its contacts 70, 76 and 78 deenergizing coil 68 and thus preventing a bypass around coil 72 from being established upon cooling of thermal element 98. Thus although the coil 99 must operate from contacts, it draws current only very briefly upon startup of the circuit and its power drain is of no consequence.

Figure 8:
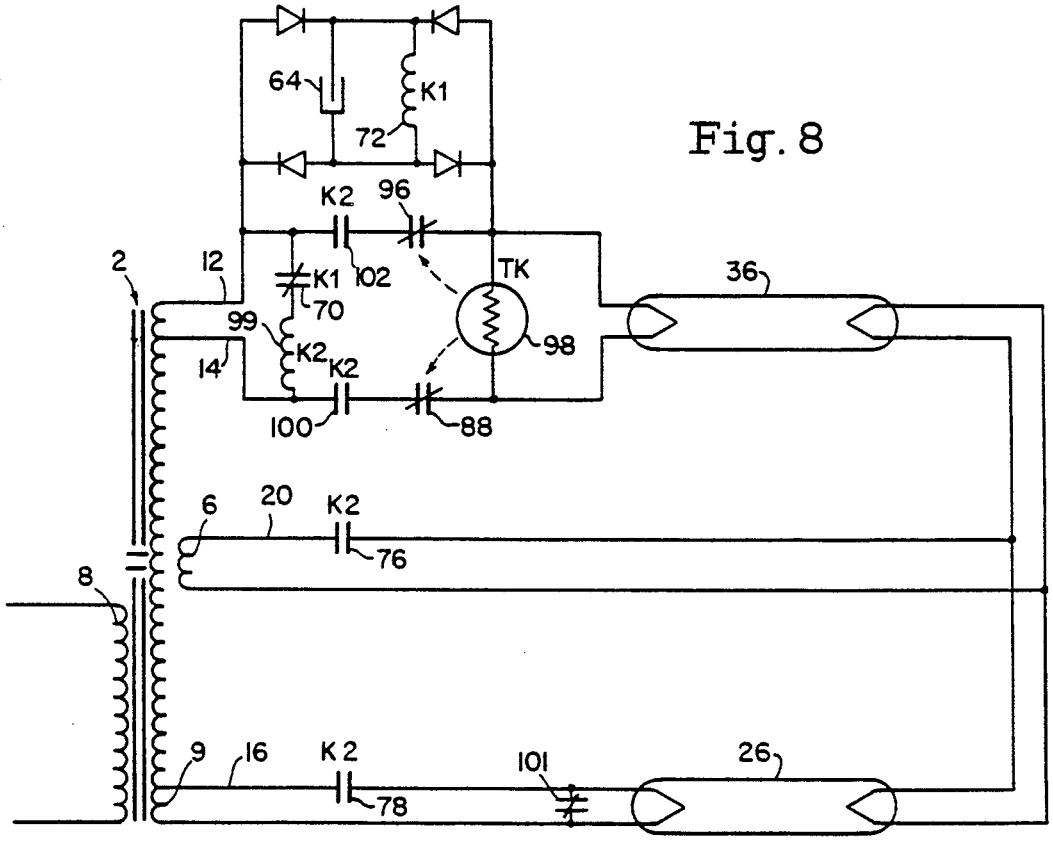
FIG. 8 illustrates a circuit employing the relays of FIG. 7 but with one of said relays located differently.
Figure 9:
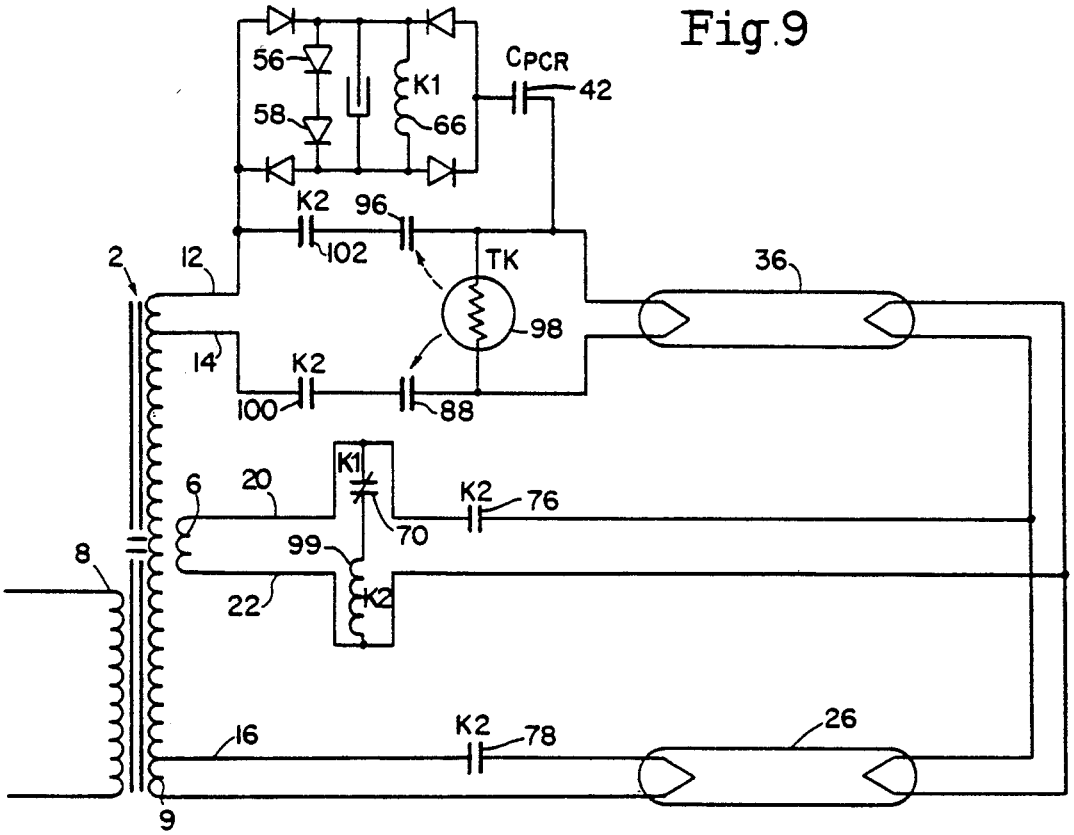
FIG. 9 illustrates a circuit employing the relays of FIG. 7 but with one of the relays located differently from its location in FIGS. 7 and 8.
Figure 10:
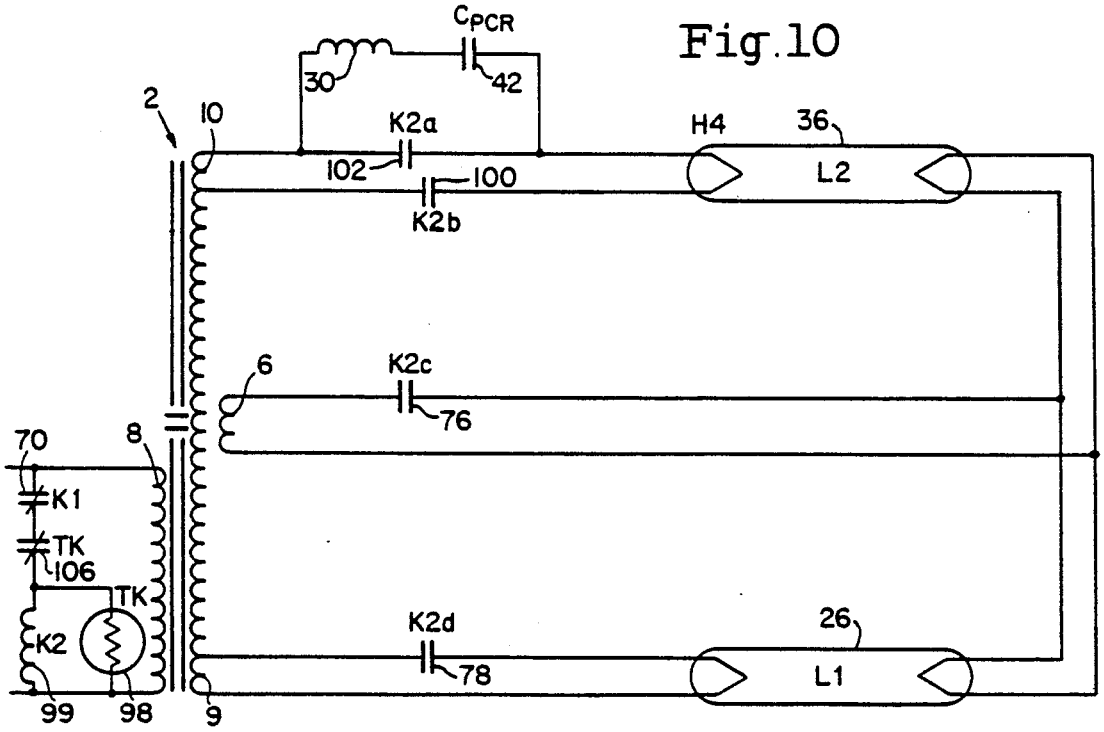
FIG. 10 illustrates a circuit employing two AC relays to control filament current.

FIGS. 8–10 illustrate circuits having the relay coil 99 and/or thermal element 98 located at various places in the circuit.

Specifically, in FIG. 8, the coil 99 series connected contact 70 of only coil 72 are connected across leads 12 and 14. The operation is the same as in FIG. 7 with coil 99 being eliminated from the circuit upon energization of the coil 72. This combination requires the least interconnection of leads between the circuits of the present invention and the standard circuitry.

It is noted that in each of the circuits of the invention, only one side of the filament circuit is opened upon commencement of plasma current and this current flows through only part of each filament. Thus the plasma current heating of the filament is not uniform and may accelerate burn-out of the filament. This situation can be corrected by establishing a connection between the two filament leads so that plasma current and the electrostatic field around the filament are equalized. This effect can be accomplished by adding a set of contacts across the filament leads such as by the normally closed contact 101 in FIG. 8. One such contact can be added across each pair of filament leads with the coil 99 opening contact 101 upon application of power to the circuit and energization of relay coil 99.

It is noted that in the circuit of FIG. 1 the contact 101 would be normally open and would be closed upon energization of coil 30 upon plasma current being established.

In FIG. 9 the coil 99 and contact 70 of relay coil 66 are connected in series across ternary winding 6 of the ballast 2. Again the coil 99 is deenergized when coil 66 is energized. It will be noted that in this figure the capacitor 42 is employed as are the overvoltage diodes 56 and 58; the latter being employed in the bridge circuit whenever the capacitor is included. It should be noted that the capacitor 42 may be included in any of the circuits described herein.

Referring now to FIG. 10 of the accompanying drawings, a circuit is illustrated which eliminates one of the contacts associated with thermal element 98. The element 98 and the coil 99 are connected in parallel and in series with a contact 106 of the thermal element and contact 70 across the primary winding 8 of the ballast 2. When the thermal element times out, its contact 106 is opened and deenergizes relay coil 99. The contacts 76, 78, 100 and 102 are opened and coil 30 is energized opening its contact 70 and maintain coil 99 and thermal element 98 deenergized.

The capacitor 42 is employed so that the bypass diodes 56 and 56 are again employed.

It should be noted that it may be preferable to locate the relay of coil 99 and the thermal relay of element 98 in the primary winding since relays operating at 110 volts may be more readily obtainable than relays operating at approximately 3 volts available across winding 6 and 10.

There is a difference in operation between the devices that utilize the Lucetta circuit with transformer 40 and those that do not use it. Specifically the lamp of circuits of FIGS. 1–3 due to the action of capacitor 42 have a reduced starting voltage across the tubes and thus it takes longer to start conduction through the tube. The light level, however, is constant from start and throughout operation. In the circuits of the latter figure whenever the capacitor 42 is employed, the capacitor is short circuited prior to conduction through the tube(s) so that the tubes fire faster. Upon establishment of plasma current the coil is energized and as a result the capacitor is inserted in the circuit. On the other hand the tubes come on with full voltage applied and thus the light level is initially at full intensity but falls upon insertion of the capacitor into the circuit.

Figure 11:
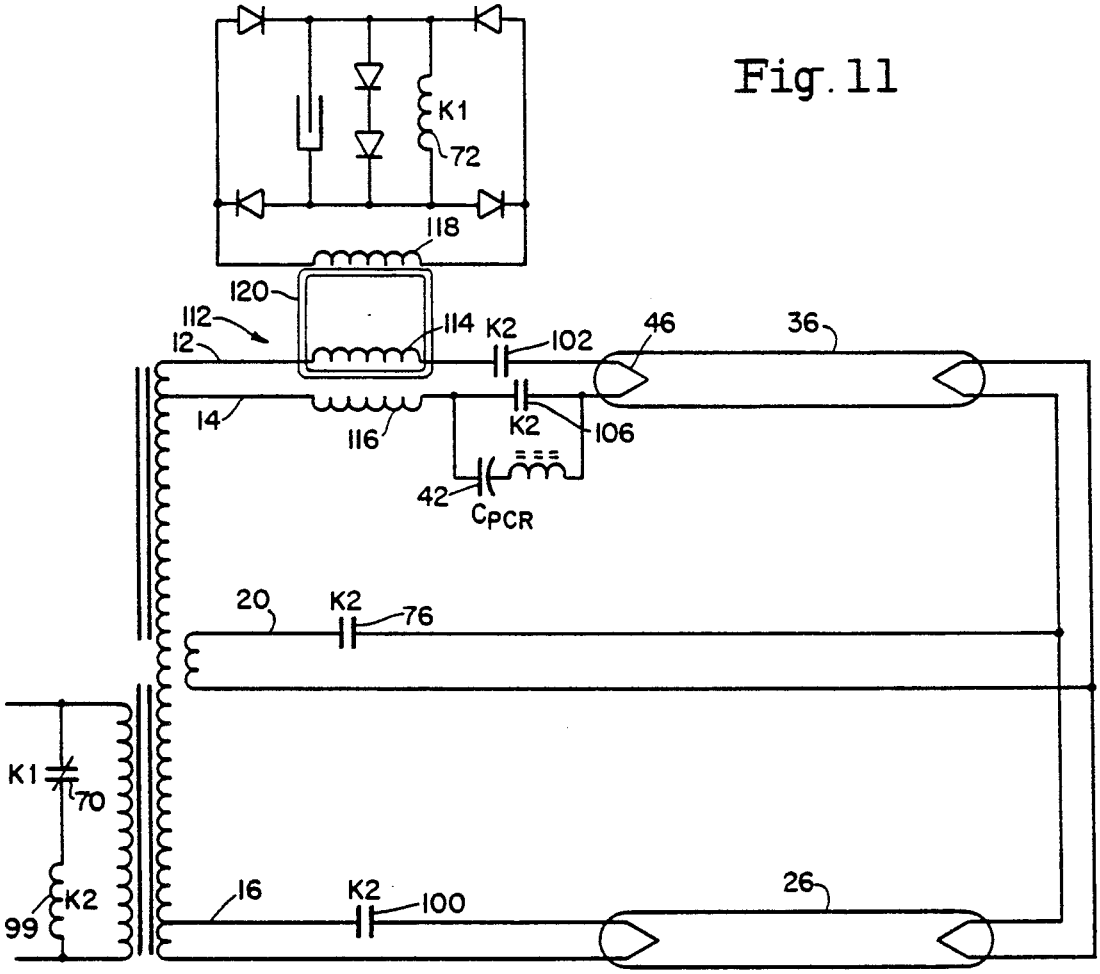
FIG. 11 illustrates a circuit employing a current transformer to control filament and plasma current.

All of the methods previously disclosed herein for detecting plasma current flow as the means of terminating filament current to the tubes are serially connected in the plasma current circuit. In FIG. 11, the detection circuit employs a current transformer 112 having three windings. One winding 114 is connected between lead 12 and a contact 102 of a relay coil 99. As in prior drawings the coil 99 is connected in series with a contact 70 of relay coil 72. A second winding 116 of current transformer 112 is connected between lead 14 and contact 100 of coil 99; the contacts 106 and 102 completing a circuit to filament 46 cf tube 36. A third winding 118 of the current transformer 112 is connected across the bridge rectifier circuit of FIG. 3. The windings 114 and 116 are preferably bifilar windings.

Heater current, since it flows in opposite directions in windings 114 and 116 produces opposed fluxes in the transformer core, designated by reference numeral 120. Thus the relay 72 is not actuated by heater current flow. Plasma current prior to actuation of relay coil 72 flows in the same direction in both coils 114 and 116 and therefore the fluxes add. After activation of relay coil 72 all plasma current flows only through the coil 116, via capacitor 42 and thus a current sufficient to operate relay 72 is generated in coil 116. By carefully selecting the relay of coil 72 and the current transformer 112, losses may be carefully controlled.

The effect of FIG. 11 may be achieved without the current transformer by using a relay coil having bifilar windings connected as the coils 114 and 116 in FIG. 11 so that the relay is activated only by plasma current flow.

Figure 12:
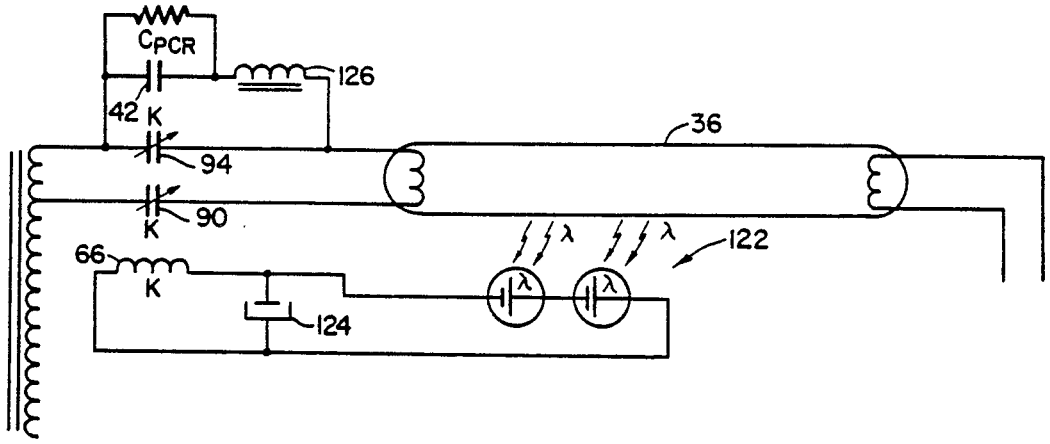
FIG. 12 illustrates a circuit employing photovoltaic cells to detect plasma current flow.

Referring now specifically to FIG. 12 of the accompanying drawings there is illustrated a circuit in which termination of filament current is achieved by photovoltaic cells. Cells 122 detect full illumination of tube 36 and generate a sufficient voltage to energize coil 72. A capacitor 124 connected in parallel with the coil 72, maintains the coil energized in spite of the 120 Hz variation in light intensity; charging during periods of high light intensity and discharging during periods of low light intensity. A current reducing capacitor 42 may also be employed together with a choke 126 to limit short circuit discharge current in the capacitor 42 when relay contacts close.

The coil 72 is associated with its normally closed contacts 90, 94 and 38 (not illustrated) to open the filament circuits when the coil is energized.

Figure 13:
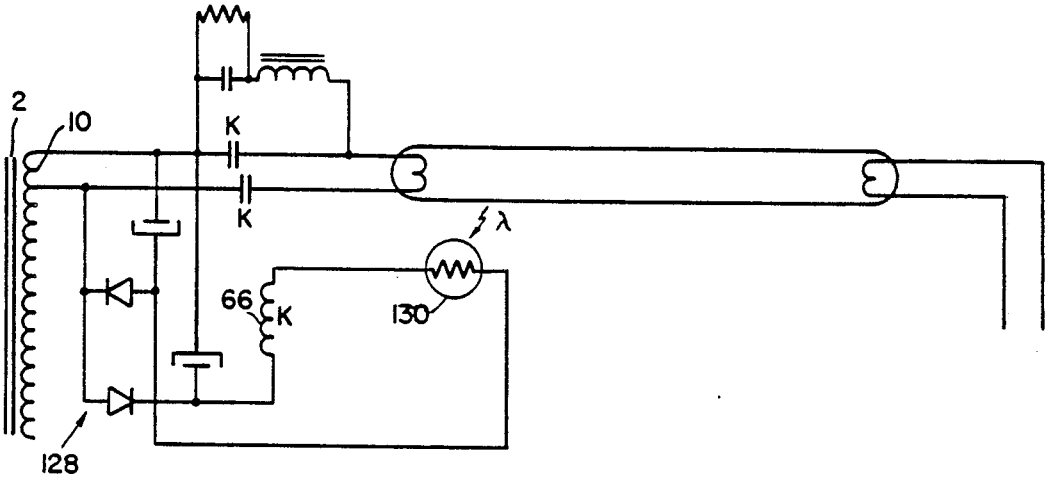
FIG. 13 illustrates a circuit employing photodiodes and the like to detect plasma current flow.

In FIG. 13 of the accompanying drawings, photodiodes, resistors, SCR, etc. may be employed together with a DC voltage derived from the winding 10 of the ballast 2. A rectifier-filter, generally designated by the reference numeral 128 provides DC to coil 66 and photodiode 130 connected in series across the DC supply. Upon the photodiode being illuminated the photodiode becomes highly conductive and the coil 66 operates its controls.

The rectifier may be half wave, full wave on a voltage doubler, etc. arrangement.

Figure 14:
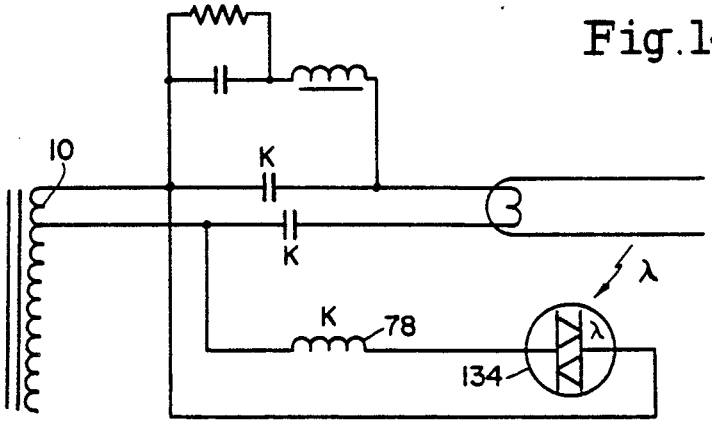
FIG. 14 illustrates the use of photo discs and the like to detect plasma current flow.

FIG. 14 illustrates an AC version of the circuit of FIG. 13. A coil 78 is connected in series with a photo disc, photo resistor on back to back photodiodes 134 across the coil 10 such that when the fluorescent tube becomes fully conductive the coil 78, which may have a condenser connected in parallel as in FIG. 12, opens its contacts in the various filament circuits.

Figure 15:
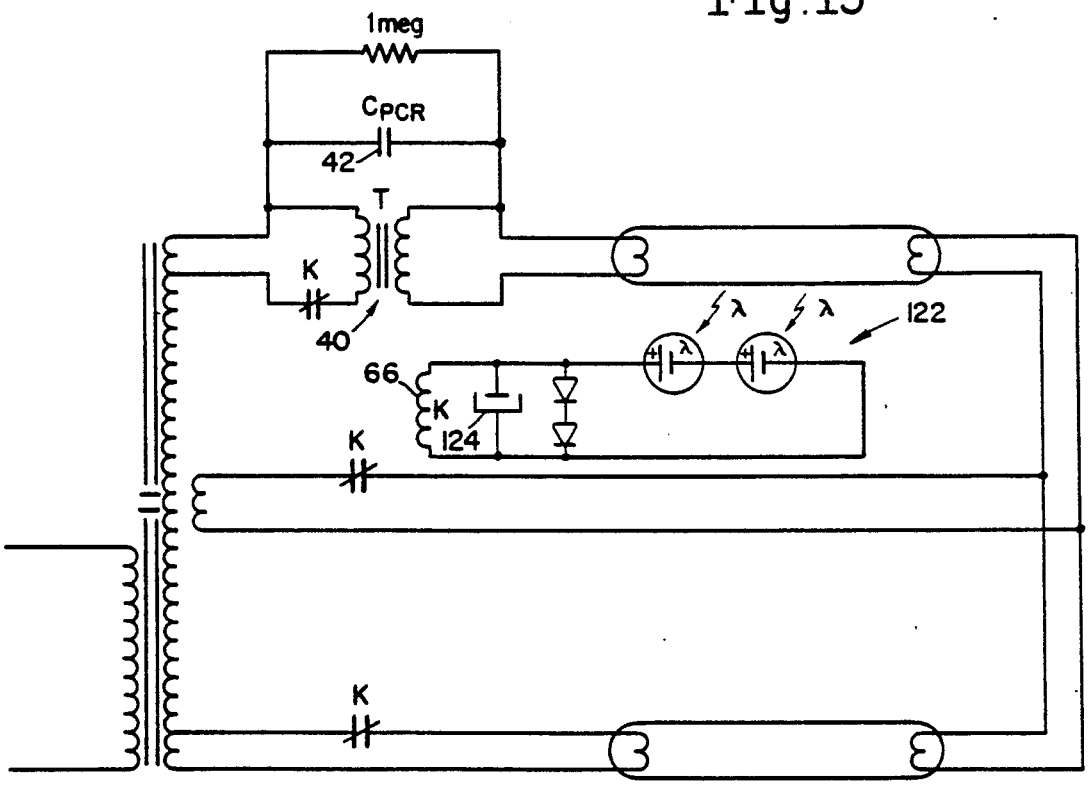
FIG. 15 illustrates a photo detection system in conjunction with the Lucetta circuit.

A final arrangement is illustrated in FIG. 15, wherein the Lucetta circuit is employed with photovoltaic cells or if desired, the arrangement of FIG. 13 and 14 also.

Transformer 40 and capacitor 42 are connected as illustrated in FIG. 1 and the coil 66 and cells 122 are as illustrated in FIG. 12.

It should be noted that the principles applied to fluorescent tube circuits are applicable to high intensity discharge lamp circuits.

It should be realized that the illustrated circuits may be employed equally well with circuits including one, two or three tubes on a conventional ballast or more with ballasts designed specifically for such operation. Also the Lucetta circuit or equivalent may be inserted in series with the tube or tubes at any filament location, not just the one location illustrated herein for convenience.

Other improvements, modifications and embodiments will become apparent to one of ordinary skill in the art upon review of this disclosure. Such improvements, modifications and embodiments are considered to be within the scope of this invention as defined by the following claims.

I claim:

1. In a circuit for energizing and including at least one discharge type tube and a ballast with a primary winding and at least two secondary windings, filament circuits for connecting each filament of a discharge type tube across a different secondary of a ballast each secondary winding providing sufficient voltage to heat the filaments of a discharge type tube to incandescence; the voltage between the secondary windings being sufficient to induce plasma current through a discharge type tube; a filament control circuit comprising:

means responsive to plasma current through a discharge type tube to substantially terminate current through at least one of the filament circuits;

a current dropping capacitor connected in series with said responsive means between one of said secondary windings and a filament of a tube, an isolation circuit inserted between said one of said secondary windings and said filament of the tube to which said capacitor is connected, a relay having a coil and a plurality of normally closed contacts with at least one contact in series with each said filament circuit, said coil maintains said current through said discharge tube, and further said means breaking the continuity of a region of said one filament circuit i parallel with said coil upon establishment of plasma current through said tube whereby said coil is energized and all of said filament circuits are opened.

2. In a circuit according to claim 1 further comprising a transformer connected in at least one of the filament circuits in parallel with said means.

3. In a circuit according to claim 1 further comprising a transformer connected in at least one of the filament circuits in parallel with said means, said capacitor and said means being connected in series with one another and in parallel with said transformer.

4. In a circuit according to claim 2 wherein said means includes a relay having at least one contact in each filament circuit.

5. In a circuit according to claim 3 wherein said means includes a relay having at least one contact in each filament circuit.

6. In a circuit according to claim 1 wherein said relay is a DC relay a rectifier circuit, still further means for applying alternating current to said rectifier circuit upon establishment of plasma current, said coil connected to receive DC voltage from said rectifier circuit.

7. In a circuit according to claim 2 wherein said means includes a relay having a coil and a plurality of normally closed contacts with one contact connected in series with a winding of said transformer and additional contacts each connected in one of each of the other filament circuits, said contact and transformer connected in series across said coil whereby upon establishment of plasma current said coil is energized.

8. In a circuit according to claim 1 wherein said means comprises a first and a second relay, said first relay having a voltage serving element and a coil in plurality of normally open contacts each connected in series with a different one of said filament circuits, said second relay having at least one normally closed contact, said normally closed contact being in series with said coil of said first relay said first relay coil being energized upon application of power to the discharge type tube circuit to close its contacts in each filament circuit, and said second relay coil being energized upon establishment of plasma current through a discharge type tube in the circuit to operate normally closed contact whereby to deenergize said filament circuits.

9. In a circuit according to claim 1 wherein said means comprises a first and a second means each for sensing an electrical condition in a discharge type tube circuit, said first of said means sensing application of power to said discharge type tube circuit to energize the filaments of discharge type tubes in the fluorescent tube circuit, said second of said means sensing the establishment of plasma current in a discharge type tube in the circuit to energize said first means whereby to terminate current in the filament circuits.

10. In a circuit according to claim 1 wherein said means comprises a first and a second means each for sensing an electrical condition in a discharge type tube circuit, said first means sensing application of power to a discharge type tube circuit and temporarily energizing the filament of the discharge type tubes after a predetermined time delay, said second means sensing plasma current through a tube in the tube circuit and in response thereto deenergizing the filament circuits for the duration of application of energy to the circuit.

11. In a circuit according to claim 1 wherein said means includes a light detecting means.

12. In a circuit according to claim 11 wherein said light detecting means is a photovoltaic cell.

13. In a circuit according to claim 11 wherein said means comprisies a relay coil and said light detecting means connected in series, said relay coil having contacts in said filament circuits.

14. A circuit according to claim 1 further comprising means for inserting said capacitor into said circuit upon initiation of plasma current.

15. A circuit according to claim 1 wherein said isolation means is a transformer.

16. A circuit according to claim 1 wherein said isolation means is a time delay circuit.

17. A circuit according to claim 1 wherein said isolation circuit is a pair of normally open contacts each in a lead to an opposite side of a filament.

* * * * *